US010580340B2

(12) United States Patent
Chen

(10) Patent No.: US 10,580,340 B2
(45) Date of Patent: Mar. 3, 2020

(54) SYSTEM AND METHOD FOR DRIVING DISPLAY

(71) Applicants: HKC Corporation Limited, Shenzhen, Guangdong (CN); Chongqing HKC Optoelectronics Technology Co., Ltd., Chongqing (CN)

(72) Inventor: Wei Chen, Chongqing (CN)

(73) Assignees: HKC CORPORATION LIMITED, Shenzhen, Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 18 days.

(21) Appl. No.: 15/745,539

(22) PCT Filed: Dec. 20, 2017

(86) PCT No.: PCT/CN2017/117335
§ 371 (c)(1),
(2) Date: Jan. 17, 2018

(87) PCT Pub. No.: WO2019/056627
PCT Pub. Date: Mar. 28, 2019

(65) Prior Publication Data

US 2019/0088182 A1 Mar. 21, 2019

(30) Foreign Application Priority Data

Sep. 19, 2017 (CN) ..... 2017 1 0847374

(51) Int. Cl.
*G09G 3/20* (2006.01)
*G09G 5/00* (2006.01)

(52) U.S. Cl.
CPC ..... *G09G 3/20* (2013.01); *G09G 5/00* (2013.01); *G09G 2330/021* (2013.01); *G09G 2340/0435* (2013.01)

(58) Field of Classification Search
CPC ..... G09G 2330/021; G09G 2340/0435; G09G 3/20; G09G 5/00
See application file for complete search history.

(56) References Cited

U.S. PATENT DOCUMENTS 7,342,564 B2 * 3/2008 Ham ..... G09G 3/3648 345/98
2004/0066363 A1 * 4/2004 Yamano ..... G09G 3/20 345/98

(Continued)

FOREIGN PATENT DOCUMENTS

CN 101770760 A 7/2010
CN 103000147 A 3/2013

(Continued)

OTHER PUBLICATIONS

International Search Report dated May 30, 2018 in corresponding PCT Application PCT/CN2017/117335, with English translation, 15 pages.

*Primary Examiner* — Dmitriy Bolotin
(74) *Attorney, Agent, or Firm* — Muncy, Geissler, Olds & Lowe, P.C.

(57) ABSTRACT

This application provides a system for driving a display, includes: a display panel; a data drive module, electrically connected to the display panel; and a signal control module, electrically connected to the data drive module. The signal control module includes: a color correspondence module, configured to receive image data of first bits, and convert the image data of first bits into image data of second bits; a data processing module, configured to divide the second bits into third bits and fourth bits; and a data construction module, (Continued)

according to a table lookup result, image data of which the number of frames and the number of bits are the same as those of data of the fourth bits, and sequentially providing the image data to the data drive module, so as to generate a corresponding data power supply for controlling the display panel to perform image display.

20 Claims, 5 Drawing Sheets

(56) References Cited

U.S. PATENT DOCUMENTS

2004/0252891 A1* 12/2004 Sasaki ..... G09G 3/3688 382/232
2005/0104834 A1* 5/2005 Tsuchihashi ..... G09G 3/3614 345/96
2005/0163492 A1* 7/2005 Ueda ..... H04N 5/783 386/228
2008/0136845 A1* 6/2008 Nakanishi ..... G09G 3/2025 345/690
2010/0098337 A1* 4/2010 Tsukamoto ..... G09G 3/2018 382/190
2010/0134533 A1* 6/2010 Moon ..... G09G 3/3611 345/690
2011/0285674 A1 11/2011 Tsai
2012/0044216 A1* 2/2012 Furihata ..... G09G 3/3688 345/204
2015/0364071 A1* 12/2015 Iida ..... G09G 3/20 345/691

FOREIGN PATENT DOCUMENTS

CN 105009192 A 10/2015
CN 106328090 A 1/2017
KR 20120022130 A 3/2012

* cited by examiner

| | Frame 1 | Frame 2 | Frame 3 | Frame 4 | Frame 5 | Frame 6 | | Frame 15 | Frame 16 |
|---|---|---|---|---|---|---|---|---|---|
| 1 | 0000<br>1000<br>0010<br>0000 | 0100<br>0000<br>0000<br>0001 | 0000<br>0010<br>1000<br>0000 | 0001<br>0000<br>0000<br>0100 | 0000<br>0100<br>0001<br>0000 | 1000<br>0000<br>0000<br>0010 | ..... | 0000<br>0001<br>0100<br>0000 | 0010<br>0000<br>0000<br>1000 |
| 2 | 0100<br>1000<br>0010<br>0001 | 0001<br>0010<br>1000<br>0100 | 1000<br>0100<br>0001<br>0010 | 0010<br>0001<br>0100<br>1000 | 0100<br>1000<br>0010<br>0001 | 0001<br>0010<br>1000<br>0100 | ..... | 1000<br>0100<br>0001<br>0010 | 0010<br>0001<br>0100<br>1000 |
| ⋮ | | | | | | | | | |
| 14 | 1011<br>0111<br>1101<br>1110 | 1110<br>1101<br>0111<br>1011 | 0111<br>1011<br>1110<br>1101 | 1101<br>1110<br>1011<br>0111 | 1011<br>0111<br>1101<br>1110 | 1110<br>1101<br>0111<br>1011 | ..... | 0111<br>1011<br>1110<br>1101 | 1101<br>1110<br>1011<br>0111 |
| 15 | 1111<br>0111<br>1101<br>1111 | 1011<br>1111<br>1111<br>1110 | 1111<br>1101<br>0111<br>1111 | 1110<br>1111<br>1111<br>1011 | 1111<br>1011<br>1110<br>1111 | 0111<br>1111<br>1111<br>1101 | ..... | 1111<br>1110<br>1011<br>1111 | 1101<br>1111<br>1111<br>0111 |

FIG. 1b

SYSTEM AND METHOD FOR DRIVING DISPLAY

BACKGROUND

Technical Field

The present invention relates to the field of display technologies, and in particular, to a method and system for driving a display.

Related Art

With the development of display technologies, flat display apparatuses such as displays are widely applied to various consumer electronic products such as mobile phones, televisions, personal digital assistants, digital cameras, notebook computers, and desktop computers due to advantages such as a high profile, power conservation, a thin design, and a wide application range, and become a mainstream in display apparatuses.

A frame rate control (FRC) technology is usually used in a display apparatus to reduce costs as well as display a high grayscale display effect. The FRC technology can represent data of high-order bits into arrangement of data of low-order bits in space or time, enabling human eyes to observe more grayscales by using visual persistence of the human eyes (feelings of human eyes for brightness do not immediately disappear with disappearance of brightness of an object). In this way, a satisfactory image display effect can be achieved while the advantage of reducing IC costs is achieved.

A 12-bit to 8-bit source drive unit is usually used, that is, a design manner of 4×4 in space and 16 frames in time is used. Generally, input display data is data that is of 12 bits and is separately constructed by three primary colors. 8 high-order bits are used for performing a lookup in an overload (OD) table, and 4 low-order bits are used for performing FRC. However, the FRC technology has this problem: a phenomenon of grayscale saturation usually exists during grayscale display, and therefore, during image display, a feeling of gridding is easily generated; in addition, because the number of frames needed by the FRC is relatively large and time needed by the FRC is relatively long, image flickers are easily generated.

SUMMARY

To resolve the foregoing technical problem, an objective of this application is to provide a system and method for driving a display, so as to reduce the number of frames needed by FRC, thereby avoiding the problem of gridding and image flickers.

The objective of this application is achieved and the technical problem of this application is resolved by using the following technical solutions. A system for driving a display according to this application includes: a display panel; a data drive module, electrically connected to the display panel; and a signal control module, electrically connected to the data drive module, and including: a color correspondence module, configured to receive image data of first bits, and calculating a preset data correspondence to convert the image data of first bits into image data of second bits; a data processing module, configured to divide the second bits into third bits and fourth bits; and a data construction module, configured to perform a table lookup for an FRC pattern according to data of the third bits, and constructing, according to a table lookup result, image data of which the number of frames and the number of bits are the same as those of data of the fourth bits, and sequentially providing the image data to the data drive module, so as to generate a corresponding data power supply for controlling the display panel to perform image display.

The technical problem of this application may be further resolved by using the following technical solutions.

In an embodiment of this application, the number of the first bits is greater than the number of the second bits.

In an embodiment of this application, the number of the second bits is less than the number of the first bits by one or more bits.

In an embodiment of this application, the input circuit and the output circuit are open circuits; the third bits are formed by high-order bits of the second bits and the fourth bits are formed by low-order bits of the second bits.

In an embodiment of this application, the number of the third bits is greater than, equal to, or less than the number of the fourth bits.

In an embodiment of this application, the data construction module includes a lookup table, and the lookup table stores a plurality of FRC patterns.

In an embodiment of this application, the data construction module selects a corresponding FRC pattern according to the data of the fourth bits.

In an embodiment of this application, during calculation of the image data of first bits, the color correspondence module calculates data of one or more lowest-order bits in the first bits by using a random FRC algorithm, and removes bits of the data of the lowest-order bits to form the second bits.

Another objective of this application is to provide a method for driving a display, including: receiving, by a color correspondence module, image data of first bits, and calculating a preset data correspondence to convert the image data of first bits into image data of second bits; dividing, by a data processing module, the second bits into third bits and fourth bits; and performing, by a data construction module, a table lookup for an FRC pattern according to data of the third bits, and constructing, according to a table lookup result, image data of which the number of frames and the number of bits are the same as those of data of the fourth bits, and sequentially providing the image data to the data drive module, so as to generate a corresponding data power supply for controlling the display panel to perform image display.

In an embodiment of this application, the number of the first bits is greater than the number of the second bits.

In an embodiment of this application, the number of the second bits is less than the number of the first bits by one or more bits.

In an embodiment of this application, the input circuit and the output circuit are open circuits; the third bits are formed by high-order bits of the second bits and the fourth bits are formed by low-order bits of the second bits.

In an embodiment of this application, the number of the third bits is greater than, equal to, or less than the number of the fourth bits.

In an embodiment of this application, the data construction module includes a lookup table, and the lookup table stores a plurality of FRC patterns.

In an embodiment of this application, the data construction module selects a corresponding FRC pattern according to the data of the fourth bits.

Still another objective of this application is to provide a system for driving a display, including: a display panel; a data drive module, electrically connected to the display panel; a signal control module, electrically connected to the data drive module, and including: a color correspondence module, configured to receive image data of 12 bits, removing data of a lowest-order bit of the 12 bits by using a random FRC algorithm, and converting the image data of 12 bits into image data of 11 bits; a data processing module, configured to divide the 11 bits into 8 high-order bits and 3 low-order bits; and a data construction module, including a lookup table storing a plurality of FRC patterns, and performing a table lookup for the FRC patterns according to data of the 8 bits in cooperation with the lookup table, constructing image data of 8 frames and 8 bits in cooperation with the 3 bits, and sequentially providing the image data to the data drive module, so as to generate a corresponding data power supply for controlling the display panel to perform image display.

According to this application, original process requirements and product costs can be maintained without greatly changing a precondition of an existing production flow, and a phenomenon of grayscale saturation seldom exists, so that a feeling of gridding generated during image display can be reduced; moreover, the number of frames needed by FRC is reduced, and a duration for grayscale calculation can be shortened, thereby avoiding a problem of image flickers. This application can also be applied to various displays having FRC technologies.

BRIEF DESCRIPTION OF THE DRAWINGS

FIG. 1*b* is a schematic diagram of grayscale corresponding values of FRC of the exemplary display apparatus;

DETAILED DESCRIPTION

Figure 1A:
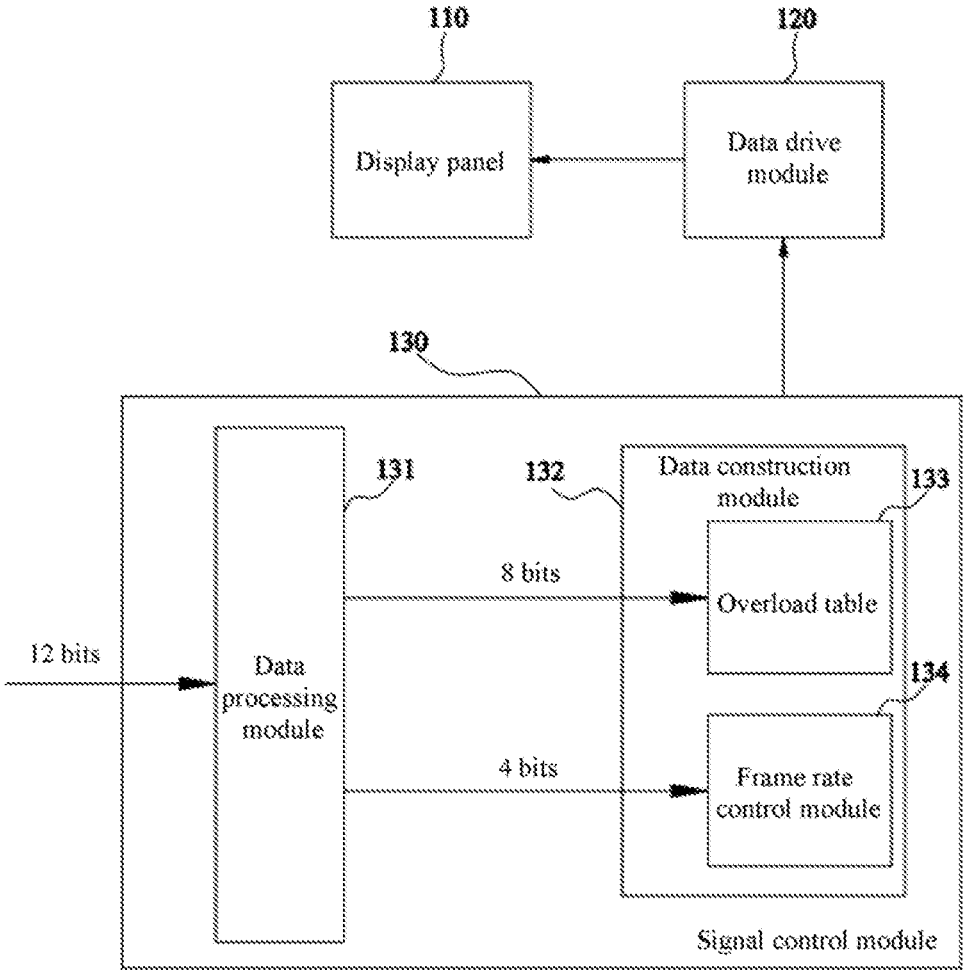
FIG. 1*a* is a schematic diagram of a drive architecture of an exemplary display apparatus.

The following embodiments are described with reference to the accompanying drawings, used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by a same reference number. In addition, for understanding and ease of description, the size and the thickness of each component shown in the accompanying drawings are randomly shown, but this application is not limited thereto.

In the accompanying drawings, for the purpose of clarity, the thicknesses of layers, films, panels, areas, and the like are enlarged, and indication of circuit configuration in related areas is also enlarged. In the accompanying drawings, for ease of understanding and description, the thicknesses of some layers and areas are enlarged, and indication of circuit configuration in related areas is also enlarged. It should be understood that when a component such as a layer, a film, an area, a circuit, or a substrate is described to be "on" another component, the component may be directly on the another component, or there may be a component therebetween.

In addition, in this specification, unless otherwise explicitly described to have an opposite meaning, the word "include" is understood as including the component, but not excluding any other component. In addition, in this specification, "on" means that a component is located above or below a target component, and does not mean that a component needs to be located on the top based on a gravity direction.

To further describe technical means used in this application to achieve a preset inventive objective and technical effects of this application, specific implementations, structures, features, and effects of a method and system that are used for driving a display and are provided according to this application are described in detail below with reference to the accompanying drawings and specific embodiments.

A display panel of this application may include a first substrate and a second substrate. The first substrate and the second substrate may be, for example, an active array switch (Thin Film Transistor, TFT) substrate and a color filter (CF) substrate. However, this application is not limited thereto. In some embodiments, an active array switch and a CF of this application may alternatively be formed on a same substrate.

In some embodiments, the display panel of this application may be, for example, a liquid crystal display panel. However, this application is not limited thereto. The display panel may alternatively be an OLED display panel, a W-OLED display panel, a QLED display panel, a plasma display panel, a curved-surface display panel, or a display panel of another type.

FIG. 1*a* is a schematic diagram of a drive architecture of an exemplary display apparatus. FIG. 1*b* is a schematic diagram of grayscale corresponding values of FRC of the exemplary display apparatus. As shown in FIG. 1*a*, a display includes a display panel 110, a data drive module 120, and a signal control module 130. The data drive module 120 is electrically connected to the display panel 110. The signal control module 130 is electrically connected to the data drive module 120. The signal control module 130 has a data processing module 131 and a data construction module 132. The data processing module 131 receives image data of 12 bits. Generally, the image data of 12 bits is data that is of 12 bits and is separately constructed by three primary colors. The data processing module 131 divides 12 bits into 8 high-order bits and 4 low-order bits. 8 high-order bits are used for performing a lookup in an OD table 133, and 4 low-order bits are transmitted to an FRC module 134 for performing FRC. Proper grayscale patterns for the FRC are selected according to a table lookup result, and the grayscale patterns are sequentially provided to the data drive module 120, so as to generate a corresponding data voltage for controlling the display panel 110 to perform image display. As drawn in FIG. 1*b*, the data construction module 132 designs 12-bit to 8-bit image data for the FRC in a manner of 4×4 in space and 16 frames in time. However, the FRC technology has this problem: a phenomenon of grayscale saturation exists during grayscale display, and therefore, during image display, a feeling of gridding is easily generated; in addition, because the number of frames needed by the FRC is relatively large and time needed by the FRC is relatively long, image flickers are easily generated.

Figure 2:
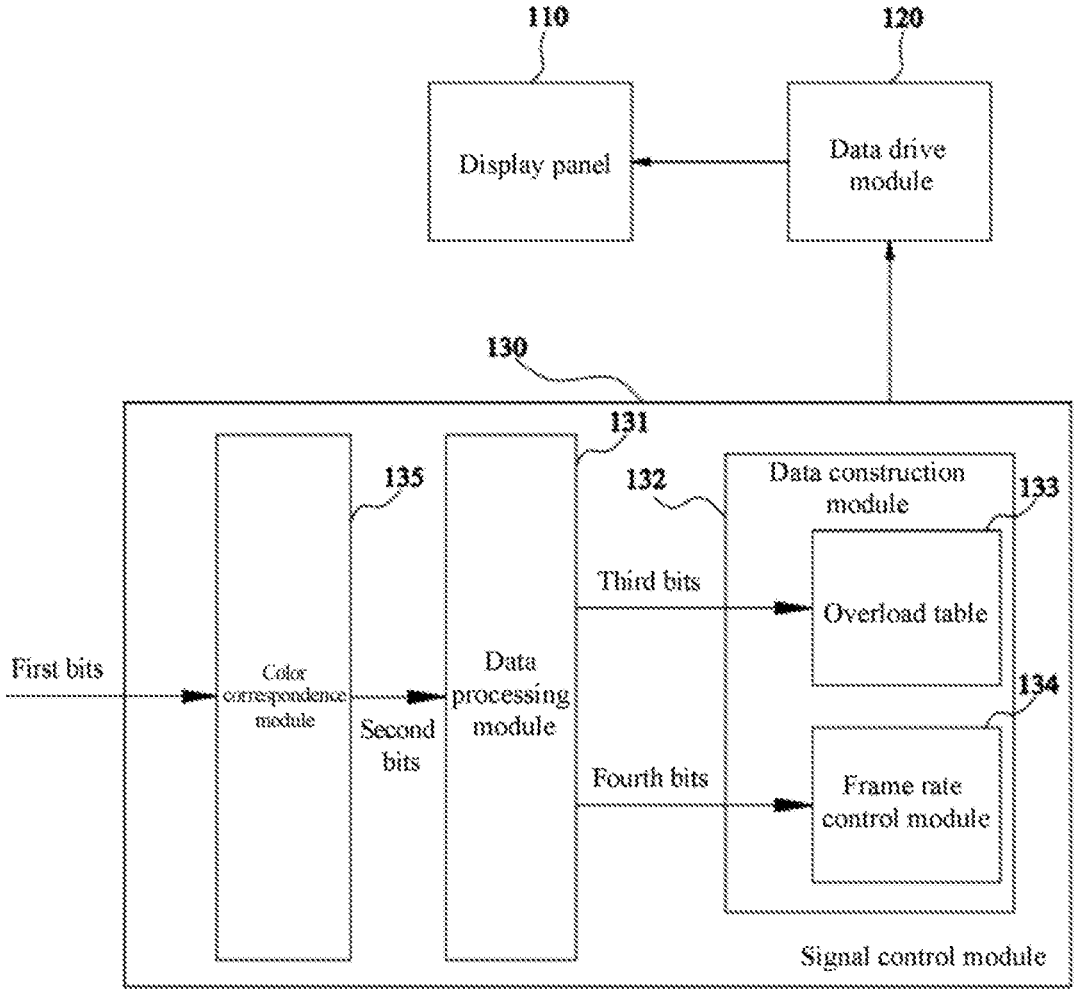
FIG. 2 is a schematic architectural diagram of an embodiment of a system for driving a display according to a method of this application.

FIG. 2 is a schematic architectural diagram of an embodiment of a system for driving a display according to a method of this application. In an embodiment of this application, the system for driving a display includes: a display panel 110; a data drive module 120, electrically connected to the display panel 110; and a signal control module 130, electrically connected to the data drive module. The signal control module 130 includes: a color correspondence module 135, configured to receive image data of first bits, and calculating a preset data correspondence to convert the image data of first bits into image data of second bits; a data processing module 131, configured to divide the second bits into third bits and fourth bits; and a data construction module 132, configured to perform, by using an FRC module 134, a table lookup for an FRC pattern according to data of the third bits, and constructing, according to a table lookup result, image data of which the number of frames and the number of bits are the same as those of data of the fourth bits, and sequentially providing the image data to the data drive module, so as to generate a corresponding data power supply for controlling the display panel 110 to perform image display.

In some embodiments, the number of the first bits is greater than the number of the second bits.

In some embodiments, the number of the second bits is less than the number of the first bits by one or more bits. For example, the number of the first bits is 8, and the number of the second bits is 6; or the number of the first bits is 12, and the number of the second bits is 11.

In some embodiments, the third bits are formed by high-order bits of the second bits and the fourth bits are formed by low-order bits of the second bits. For example, if the number of the second bits is 9, the third bits may be high-order 6 bits, and the fourth bits may be low-order 3 bits; or if the number of the second bits is 11, the third bits may be high-order 8 bits, and the fourth bits may be low-order 3 bits.

In some embodiments, the number of the third bits is greater than, equal to, or less than the number of the fourth bits.

In some embodiments, the data construction module 132 includes a lookup table, and the lookup table stores a plurality of FRC patterns.

In some embodiments, the data construction module 132 selects a corresponding FRC pattern according to the data of the fourth bits. The data construction module 132 performs an OD table lookup according to the third bits, and selects an FRC pattern according to the fourth bits.

In some embodiments, during calculation of the image data of first bits, the color correspondence module 135 calculates data of one or more lowest-order bits in the first bits by using a random FRC algorithm, and removes bits of the data of the lowest-order bits to form the second bits.

Figure 3:
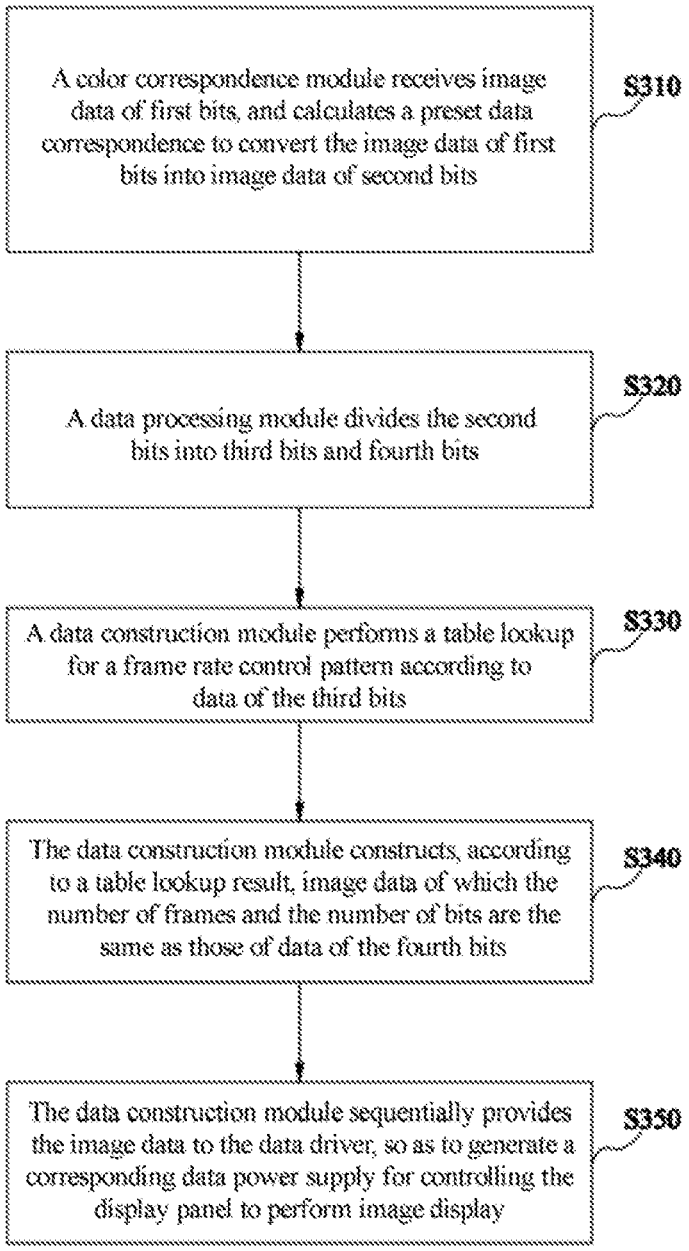
FIG. 3 is a schematic diagram of an embodiment of a drive process of a display according to a method of this application; refer to FIG. 2 to facilitate understanding of FIG. 3.

FIG. 3 is a schematic diagram of an embodiment of a drive process of a display according to a method of this application. Refer to FIG. 2 to facilitate understanding of FIG. 3. In an embodiment of this application, a method for driving a display includes:

step S310: A color correspondence module 135 receives image data of first bits, and calculates a preset data correspondence to convert the image data of first bits into image data of second bits;

step S320: A data processing module 131 divides the second bits into third bits and fourth bits;

step S330: A data construction module 132 performs a table lookup for an FRC pattern according to data of the third bits;

step S340: The data construction module 132 constructs, according to a table lookup result, image data of which the number of frames and the number of bits are the same as those of data of the fourth bits; and step S350: The data construction module 132 sequentially provides the image data to the data drive module, so as to generate a corresponding data power supply for controlling the display panel 110 to perform image display.

Figure 4:
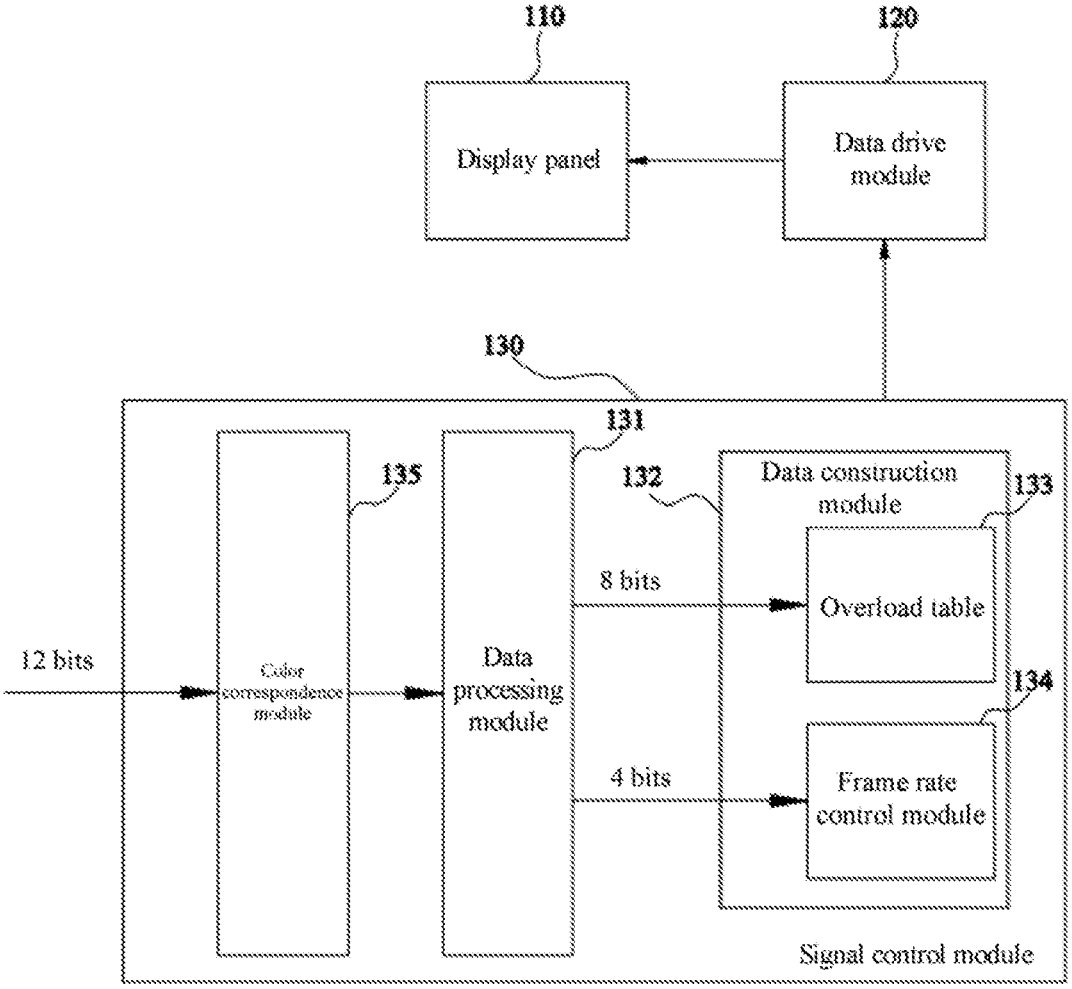
FIG. 4 is a schematic architectural diagram of an embodiment of a system for driving a display according to a method of this application.

FIG. 4 is a schematic architectural diagram of an embodiment of a system for driving a display according to a method of this application. In an embodiment of this application, the system for driving a display includes: a display panel 110; a data drive module 120, electrically connected to the display panel 110; and a signal control module 130, electrically connected to the data drive module. The signal control module 130 includes: a color correspondence module 135, configured to receive image data of 12 bits, removing data of a lowest-order bit of the 12 bits by using a random FRC algorithm, and converting the image data of 12 bits into image data of 11 bits; a data processing module 131, configured to divide the 11 bits into 8 high-order bits and 3 low-order bits; and a data construction module 132, including a lookup table storing a plurality of FRC patterns, and performing a table lookup for the FRC patterns according to data of the 8 bits in cooperation with the lookup table, constructing image data of 8 frames and 8 bits in cooperation with the 3 bits, and sequentially providing the image data to the data drive module, so as to generate a corresponding data power supply for controlling the display panel 110 to perform image display.

According to this application, original process requirements and product costs can be maintained without greatly changing a precondition of an existing production flow, and a phenomenon of grayscale saturation seldom exists, moreover, the number of frames needed by FRC is reduced, and a duration for grayscale calculation can be shortened, for example, a speed of 12-bit to 8-bit frame rate calculation can be accelerated by 12/8 times, so that a feeling of gridding generated during image display can be reduced; in addition, a problem of image flickers can be avoided. This application can also be applied to various displays having FRC technologies.

Phrases such as "in some embodiments" and "in various embodiments" are repeatedly used. Usually, the phrases do not indicate same embodiments, but may also indicate same embodiments. Words, such as "comprise", "have", and "include" are synonyms, unless other meanings are indicated in the context.

The foregoing descriptions are merely specific embodiments of this application, and are not intended to limit this application in any form. Although this application has been disclosed above through the specific embodiments, the embodiments are not intended to limit this application. Any person skilled in the art can make some variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A system for driving a display, comprising:

a display panel;

a data drive module, electrically connected to the display panel;

a signal control module, electrically connected to the data drive module, and comprising:

a color correspondence module, configured to receive image data of first bits, and calculating a preset data correspondence to convert the image data of first bits into image data of second bits;

a data processing module, configured to divide the second bits into third bits and fourth bits; and a data construction module, configured to perform a table lookup for a frame rate control pattern according to data of the third bits, and constructing, according to a result of the table lookup, image data of which the number of bits are the same as those of image data of the fourth bits, and sequentially providing the image data to the data drive module, so as to generate a corresponding data power supply for controlling the display panel to perform image display.

2. The system for driving a display according to claim 1, wherein the number of the first bits is greater than the number of the second bits.

3. The system for driving a display according to claim 2, wherein the number of the second bits is less than the number of the first bits by one or more bits.

4. The system for driving a display according to claim 1, wherein the third bits are formed by high-order bits of the second bits and the fourth bits are formed by low-order bits of the second bits.

5. The system for driving a display according to claim 4, wherein the number of the third bits is greater than the number of the fourth bits.

6. The system for driving a display according to claim 4, wherein the number of the third bits is equal to the number of the fourth bits.

7. The system for driving a display according to claim 4, wherein the number of the third bits is less than the number of the fourth bits.

8. The system for driving a display according to claim 4, wherein the data construction module comprises a lookup table, and the lookup table stores a plurality of frame rate control patterns.

9. The system for driving a display according to claim 8, wherein the data construction module selects a corresponding frame rate control pattern according to the data of the fourth bits.

10. The system for driving a display according to claim 9, wherein during calculation of the image data of first bits, the color correspondence module calculates data of one or more lowest-order bits in the first bits by using a random frame rate control algorithm, and removes bits of the data of the lowest-order bits to form the second bits.

11. A method for driving a display, comprising:

receiving, by a color correspondence module, image data of first bits, and calculating a preset data correspondence to convert the image data of first bits into image data of second bits; dividing, by a data processing module, the second bits into third bits and fourth bits; and performing, by a data construction module, a table lookup for a frame rate control pattern according to data of the third bits, and constructing, according to a result of the table lookup, image data of which the number of bits are the same as those of image data of the fourth bits, and sequentially providing the image data to the data drive module, so as to generate a corresponding data power supply for controlling the display panel to perform image display.

12. The method for driving a display according to claim 11, wherein the number of the first bits is greater than the number of the second bits.

13. The method for driving a display according to claim 12, wherein the number of the second bits is less than the number of the first bits by one or more bits.

14. The method for driving a display according to claim 11, wherein the third bits are formed by high-order bits of the second bits and the fourth bits are formed by low-order bits of the second bits.

15. The method for driving a display according to claim 14, wherein the number of the third bits is greater than the number of the fourth bits.

16. The method for driving a display according to claim 14, wherein the number of the third bits is equal to the number of the fourth bits.

17. The method for driving a display according to claim 14, wherein the number of the third bits is less than the number of the fourth bits.

18. The method for driving a display according to claim 14, wherein the data construction module comprises a lookup table, and the lookup table stores a plurality of frame rate control patterns.

19. The method for driving a display according to claim 18, wherein the data construction module selects a corresponding frame rate control pattern according to the data of the fourth bits.

20. A system for driving a display, comprising:

a display panel;

a data drive module, electrically connected to the display panel;

a signal control module, electrically connected to the data drive module, and comprising:

a color correspondence module, configured to receive image data of 12 bits, removing data of a lowest-order bit of the 12 bits by using a random frame rate control algorithm, and converting the image data of 12 bits into image data of 11 bits;

a data processing module, configured to divide the 11 bits into 8 high-order bits and 3 low-order bits; and a data construction module, comprising a lookup table storing a plurality of frame rate control patterns, and performing a table lookup for the frame rate control patterns according to data of the 8 bits in cooperation with the lookup table, constructing image data of 8 frames and 8 bits in cooperation with the 3 bits, and sequentially providing the image data to the data drive module, so as to generate a corresponding data power supply for controlling the display panel to perform image display.

* * * * *